US009878843B2

(12) United States Patent
Nabeiro et al.

(10) Patent No.: US 9,878,843 B2
(45) Date of Patent: Jan. 30, 2018

(54) CAPSULE INCLUDING ACTUATION ELEMENT, METHOD AND DEVICE FOR PROCESSING SAID CAPSULE

(75) Inventors: Rui Miguel Nabeiro, Campo Maior (PT); Daniel Freire Falcão T. Caramelo, Lisbon (PT)

(73) Assignee: NOVADELTA—COMÉRCIO E INDÚSTRIA DE CAFÉS.A., Lisbon (PT)

( * ) Notice: Subject to any disclaimer, the term of this patent is extended or adjusted under 35 U.S.C. 154(b) by 718 days.

(21) Appl. No.: 14/008,818

(22) PCT Filed: Mar. 30, 2012

(86) PCT No.: PCT/PT2012/000012
§ 371 (c)(1),
(2), (4) Date: Sep. 30, 2013

(87) PCT Pub. No.: WO2012/134313
PCT Pub. Date: Oct. 4, 2012

(65) Prior Publication Data

US 2014/0020565 A1 Jan. 23, 2014

(30) Foreign Application Priority Data

Mar. 30, 2011 (PT) ..... 105599

(51) Int. Cl.
*B65D 85/804* (2006.01)

(52) U.S. Cl.
CPC ..... *B65D 85/8043* (2013.01); *B65D 85/8046* (2013.01)

(58) Field of Classification Search
CPC ..... B65D 85/8043; B65D 85/8046
(Continued)

(56) References Cited

U.S. PATENT DOCUMENTS 5,656,316 A * 8/1997 Fond ..... A47J 31/0678 426/112
7,243,597 B2 * 7/2007 Hu ..... A47J 31/4496 99/283
(Continued)

FOREIGN PATENT DOCUMENTS

DE 10 2010 030 988 A1 1/2012
EP 1 975 087 A2 10/2008
(Continued)

OTHER PUBLICATIONS

International Search Report for PCT/PT2012/000012, dated Jul. 23, 2012.

*Primary Examiner* — David Angwin
*Assistant Examiner* — John J Norton
(74) *Attorney, Agent, or Firm* — Sughrue Mion, PLLC

(57) ABSTRACT

A capsule used in the production of a beverage, includes an actuation element that is displaced by an actuation force. The actuation element is configured with a section of passageway and controls the moments of entry and exit of a pressurized flow through the capsule. The actuation element includes a flow accumulation chamber provided on a side of the zone facing the flow downstream, and at least one flow exit passage for discharge of the flow out of the accumulation chamber and of the capsule, at least in part as a result of flow accumulation in the flow accumulation chamber.

11 Claims, 4 Drawing Sheets

(58) Field of Classification Search
USPC ..... 99/295; 426/115
See application file for complete search history.

(56) References Cited

U.S. PATENT DOCUMENTS

| | | | | |
|---|---|---|---|---|
| 7,946,217 | B2 * | 5/2011 | Favre | A47J 31/0668 426/433 |
| 2003/0056661 | A1 * | 3/2003 | Hu | A47J 31/0668 99/495 |
| 2003/0096038 | A1 * | 5/2003 | Cai | A47J 31/14 426/77 |
| 2004/0115317 | A1 * | 6/2004 | Doglioni | A47J 31/0673 426/123 |
| 2009/0223375 | A1 * | 9/2009 | Verbeek | A47J 31/405 99/287 |
| 2010/0147156 | A1 | 7/2010 | Colantonio et al. | |
| 2010/0180774 | A1 | 7/2010 | Kollep et al. | |
| 2012/0263829 | A1 * | 10/2012 | Kamerbeek | A47J 31/0673 426/77 |

FOREIGN PATENT DOCUMENTS

| | | | | |
|---|---|---|---|---|
| EP | 2 210 826 | A1 | 7/2010 | |
| NL | WO 2010137948 | A1 * | 12/2010 | A47J 31/3695 |
| NL | WO 2010137949 | A1 * | 12/2010 | A47J 31/3695 |
| WO | 2008/132571 | A1 | 11/2008 | |
| WO | 2010/137947 | A1 | 12/2010 | |
| WO | 2011/035942 | A1 | 3/2011 | |
| WO | 2011/138405 | A1 | 11/2011 | |

* cited by examiner

CAPSULE INCLUDING ACTUATION ELEMENT, METHOD AND DEVICE FOR PROCESSING SAID CAPSULE

CROSS REFERENCE TO RELATED APPLICATIONS

This is a National Stage of International Application No. PCT/PT2012/000012, filed Mar. 30, 2012, claiming priority from Portuguese Patent Application No. 105599, filed Mar. 30, 2011, the contents of all of which are incorporated herein by reference in their entirety.

FIELD OF THE INVENTION

The present invention refers to the field of capsules of aromatic substances used for the preparation of beverages by extraction by means of their crossing by a pressurized fluid flow, in general, and to the field of the capsules for obtaining coffee of the espresso type, in particular.

The present invention further refers to a method of processing said recipient, as well as to a device for executing this method of processing.

BACKGROUND OF THE INVENTION

There are presently known many solutions of capsules meant for use in beverage extraction machines, such as espresso coffee, including of the pod type, provided in a substantially air un-tight material, and of the capsule type, provided in substantially airtight materials. The opening of such kind of recipients, for passage of the extraction flow, raises several questions from the technical point of view, both in terms of the control upon the moments of entry and exit (and, therefore, of the flow residence period in its interior) as well as in terms of the configuration of the section of flow passage (format, dimension, distribution) for the entry and for the exit of said pressurized fluid flow. In fact, these parameters have a substantial influence upon the final quality of the beverage obtained and, in general, vary according to the type of aromatic substance being used. Moreover, it is further important to consider the set of forces required by an extraction device, notably in a respective extraction chamber, to carry out said opening of entry and exit of the capsule, as well as an eventual variation of the latter for different types of substances being used.

The solution usually practiced for the opening of the capsule relates to a certain form of rupture of a certain material used in a construction element in a certain zone of the capsule, usually as a result of the application of a certain mechanical force. Moreover, one frequently tries to use the hydraulic force generated inside the capsule by the pressurized fluid flow, to also actuate, at least in part, the exit out of it.

Document EP 1975087 presents a capsule including a tubular element disposed inside and participating in the distribution of the pressurized fluid flow, from the entry in the capsule to the exit therefrom. Also in this case the opening of the flow entry and exit is carried out by means of perforating the construction material in respective zones. Moreover, in this case, the tubular element is not actuated so as to carry out any displacement. The tubular element provides, in a passive manner, an assisting function to the flow distribution inside the capsule, but does not carry out any flow actuation function.

BRIEF DESCRIPTION OF THE INVENTION

The goal of the present invention is to make a capsule available, or recipients of the capsule type, that provides better flow conditions at the entry and at the exit, thereby minimizing the associated pressure losses, a better flow distribution inside the capsule, that way maximizing the efficacy of the extraction process, as well as, in particular, a better control upon and use of the forces necessary to carry out the flow entry and exit that way better controlling the flow residence period inside the capsule, and with the possibility of adjusting the latter to different types of aromatic substances and beverages, with minimal constructive changes.

The aforementioned goal is solved by means of a capsule, produced in a substantially flexible or rigid material, and substantially gas un-tight or gastight, containing at least one aromatic substance, for production of a beverage by means of its crossing by a pressurized fluid flow, whereby said capsule is built by at least one construction element defining at least one zone of capsule facing the flow upstream and a zone of capsule facing the flow downstream disposed in opposition between each other, and presenting an actuation element that extends over part, preferentially a substantial part, of the distance between the zones facing the flow upstream and downstream, and retained in a removable manner in a respective element fixture, provided in each case in said zones facing the flow upstream and downstream. According to a first inventive aspect, said actuation element and respective element fixture are configures in such a way that they include and/or define a flow accumulation chamber on the side of the zone facing the flow downstream, and at least one previously defined flow passageway of exit, for flow discharge out of said accumulation chamber and out of the capsule. In terms of the mechanism of forces, this discharge unfolds at least in part, as a result of the flow accumulation in said flow accumulation chamber.

According to another inventive aspect, said actuation element executes at least two successive displacements, in each case as a result of the application of a certain actuation force, in each case resulting in at least one previously defined flow passageway for the flow to entry in the capsule, and said, at least one, previously defined flow passage out of the capsule, respectively.

According to another inventive aspect, as a result of the displacement of the actuation element there is released at least one previously defined flow passageway for the flow to enter inside the accumulation chamber.

In this sense, the present invention points to advantageous configurations of the actuation element and respective element fixture, in view of the respective actuation effectiveness and simplicity of the construction means involved.

According to another inventive aspect, the actuation element and/or the element fixture are therefore advantageously provided with at least one, preferentially a plurality of passageways and/or at least one permeable material and/or with filtering effect, whereby at least the flow passageways through the accumulation chamber are preferentially made available when said passageways, provided in each case in the actuation element and/or element fixture, are in each case un-obstructed or get in substantial fluid communication with each other.

According to another inventive aspect, the parts of the actuation element are configured so as to interact at least temporarily with each other, preferentially so that they move in isolation relative to the other, along at least part of the distance between the zone facing upstream flow and the zone facing downstream flow.

Further within this scope, according to a preferred embodiment, the actuation element is provided in two actuation parts, each being retained at least initially by at least one respective removable union, preferentially in an union by means of positive locking. Moreover, at least the one part of the actuation element on the side of the zone facing the flow downstream, is retained so that it can be displaced in a respective element fixture, preferentially by means of two unions disposed successively along the prevailing flow direction, whereby at least the first thereof is configured as a removable union.

One other goal of the present invention is to be able to adjust said capsule to the use of different types of substances, different average dimension of respective grains and different quantity of beverage to be produced, only by means of a variation of the configuration and/or previous dimensioning of said actuation element, thereby always ensuring a high extraction efficacy.

This goal is solved according to an inventive aspect in such way that the total displacement of the actuation element and/or the volume of the accumulation chamber, preferentially the respective interior height, are previously defined as a function at least of the type of aromatic substance, or of the dimension of the grain of said substance, or of the interior volume of the capsule.

According to another inventive aspect, the configuration at least of the flow passages of entry n the accumulation chamber and of exit from the capsule, preferentially including the form, the dimension and/or the distribution of respective passageways, is previously defined as a function at least of the type of aromatic substance and/or of the dimension of the grain of said substance and/or of the interior volume of the capsule.

According to a preferred embodiment, and so as to increase the options of control upon the residence period of the flow inside the capsule, notably in view of different aromatic substances, there are provided at least two flow passages, at least in the exit chamber of the actuation element and in the exit cavity, respectively, which result in substantial fluid communication with each other as a result of removing one removable union.

According to a preferred embodiment, the flow passages are provided in the form of a plurality of passageways and/or of liquid permeable material and/or with filtering effect. Preferred embodiments of such material include materials with a fibre-based structure, preferentially biodegradable materials.

One other goal of the invention is to provide a certain flow pattern inside the capsule, in view of higher effectiveness of extraction of the aromatic substance in its interior.

To this purpose, according to another inventive aspect, it is provided a plurality of flow passages, disposed successively along the prevailing flow direction, whereby the distance between successive flow passages is previously dimensioned and the respective passageways develop in a substantially uniform manner radially, preferentially in asymmetric manner radially, relative to the central symmetry axis of the capsule.

According to another inventive aspect, the parts of the actuation element are provided so that at least one may move at least partially along the other, or at least one may move along at least part of the respective element fixture, at least along the flow prevailing direction.

According to a preferred embodiment, the extension of the actuation element, preferentially at least of the part of the actuation element disposed on the side of the zone facing the flow upstream, is previously defined as a function at least of the type of aromatic substance and/or of the measured dimension of the grain and/or of the global volume of the capsule.

According to another preferred embodiment, the capsule is provided with identification means of a certain previously defined operating position, in particular of a certain relative orientation when the crossing flow should be carried out along a substantially horizontal direction, such as for example so that an identifying element is facing upwards.

One other goal of the present invention is to provide a method of production of an aromatic beverage from a capsule according to the present invention.

The goal above is solved by means of a method comprising the steps of introducing a capsule into an extraction chamber, mechanical fixation clamping of the capsule in the extraction chamber, that way exerting a first actuation force upon the actuation element, at least on the side of the zone facing the flow upstream, of injecting a fluid flow under a previously defined pressure and during a period of time, thereby exerting a second actuation force upon the actuation element, at least on the side of the zone facing the flow downstream, so that the first force of actuation is sufficient to displace the actuation element in such a way that at least reduces the second actuation force, still necessary to provide a flow passage out of the capsule.

According to another inventive aspect, by means of the mechanical clamping of the capsule in the extraction chamber, at least part of the first actuation force applied upon the actuation element disposed on the side of the zone facing the flow upstream, is transmitted by the latter to the actuation element disposed on the side of the zone facing the flow downstream, so that the latter is displaced out of its initial retention.

According to another preferred embodiment, after beginning the injection of pressurized fluid flow the latter is immediately introduced inside the capsule through a flow passage.

According to another preferred embodiment, by means of the mechanical clamping of the capsule in the extraction chamber, the actuation elements are displaced from an initial blocking situation to a following situation of opening of at least one in each case respective flow passage.

According to another preferred embodiment, by means of crossing the capsule, the pressurized fluid flow accumulates at least during a certain period in the accumulation chamber, thereby exerting an increasing hydraulic actuation force upon the actuation element disposed on the side of the zone facing the flow downstream, until reaching a minimum value that provokes the displacement of the actuation element and that way releases at least one respective flow passage.

According to another preferred embodiment of the method according to the invention, the capsule is introduced along a previously defined orientation inside the extraction chamber, preferentially so that the flow passage out of the capsule results oriented downwards.

One other goal of the present invention is to provide a beverage extraction device, whereby this goal is solved by means of a device for use of a capsule according to the invention that comprises at least one extraction chamber for executing the method according to the invention.

DESCRIPTION OF THE DRAWINGS

The invention shall now be explained in greater detail based upon preferred embodiments and upon the attached Figures.

The Figures show.

DETAILED DESCRIPTION OF THE INVENTION

Figure 1A:
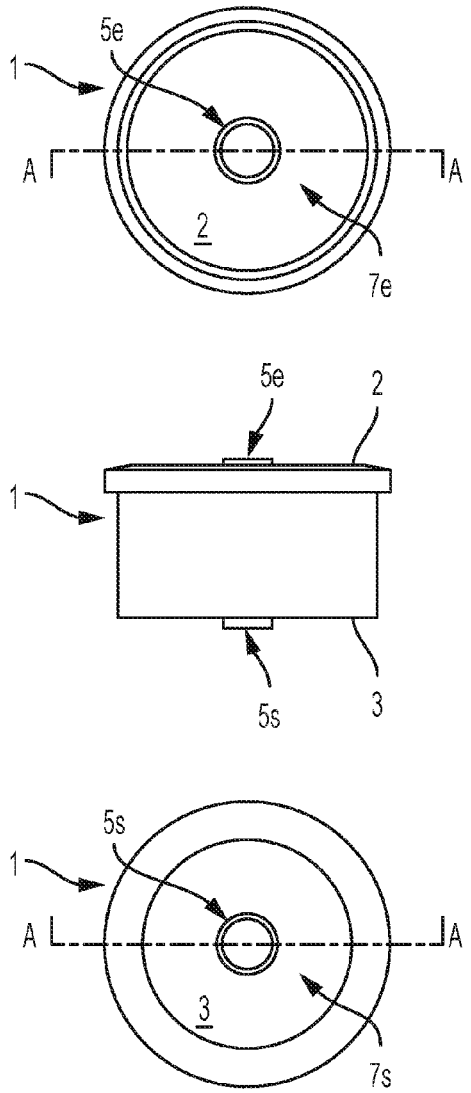
FIGS. 1*a*-1*b*: views in top view, side view and bottom view, respectively, of a recipient of the type capsule (1) and pod (1') according to the invention, including one entry and exit actuation element (5) simultaneously retained in a zone (2) facing the flow upstream and in a zone (3) facing the flow downstream of said capsule.
Figure 1B:
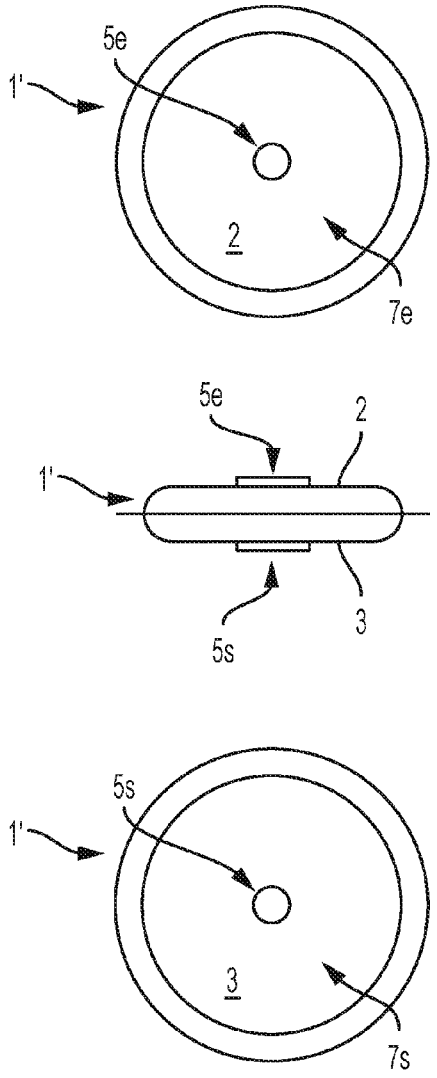

FIGS. 1*a*-1*b* are outside views of two representative embodiments, for illustrative purpose and non-limiting of the scope of the invention, of a recipient of the type capsule (1, 1') according to the invention. In a first case (FIG. 1*a*), it is a capsule (1) configured in form of a box and produced in a substantially rigid and gastight material, and in another illustrative case (FIG. 1*b*), it is a capsule (1') configured in form of a pod and produced in a substantially flexible and gas un-tight material.

This type of capsules (1, 1') collects an aromatic substance in its interior and is meant for the production of an aromatic beverage by means of its crossing by a pressurized fluid flow, such as for example hot water. Typically, the capsule (1) comprises at least one, preferentially two construction elements, in particular in this case one element of the container type and one element of the lid type, that define at least one zone (2) facing the flow upstream and one zone (3) facing the flow downstream.

In the case of the present invention, the capsule (1, 1') further includes at least one actuation element (5) disposed in its interior so that it is retained in a removable manner, preferentially in an airtight manner under pressure, in a respective element fixture (7) disposed in each case both in the zone (2) of upstream flow as well as in the zone (3) of downstream flow. The capsule (1, 1') is processed by a respective device by means of its placement inside an extraction chamber (10) with the zone (2) of upstream flow oriented to a fluid injection (11) that feeds the pressurized flow to the interior of the capsule (1, 1'), and the zone (3) of downstream flow facing an infusion discharge (12) that gathers the flow from the interior of the capsule (1, 1')—vide FIG. 4.

Figure 2A:
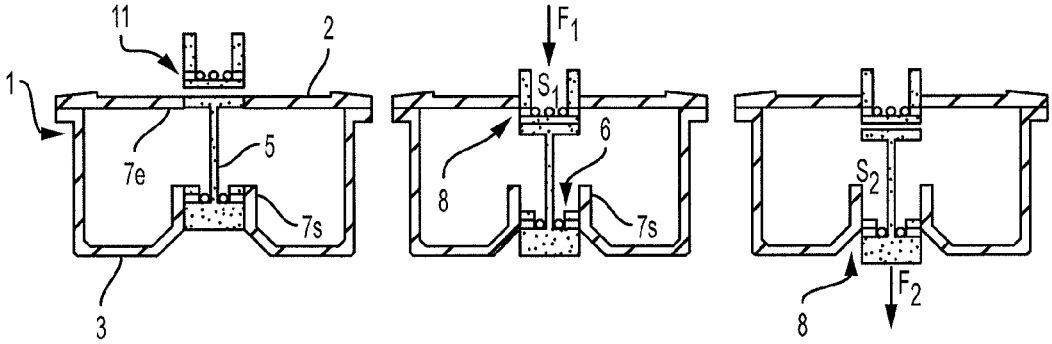
FIGS. 2*a*-2*b*: schematic representation in cut, along the AA plane identified in FIG. 1, of a first type of embodiments of a capsule (1) according to the invention, including the evolution of an actuation element (5) that moves inside the capsule (1), in particular in an element fixture (7*s*) with a cavity form on the zone (3) facing the flow downstream.
Figure 2B:
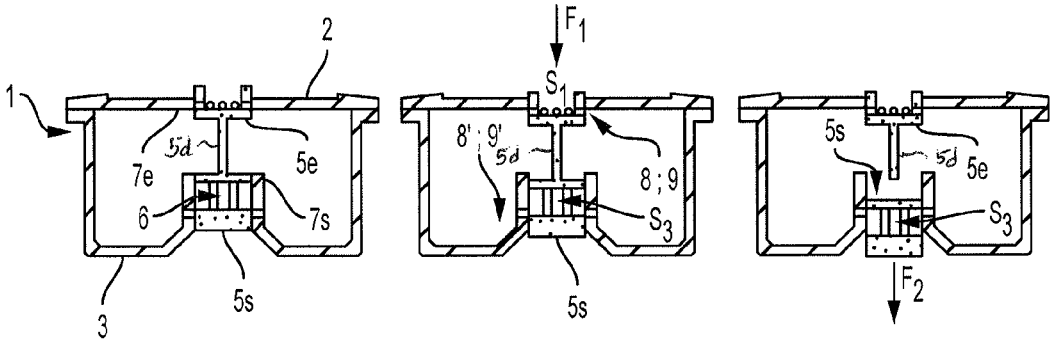

FIGS. 2*a* and 2*b* correspond to views in cut of two embodiments, respectively, each thereof corresponding to one of three successive moments of extraction of a capsule (1, 1') according to the present invention. In the case of this set of embodiments, the element fixture (7) is provided in two distinct parts (7*e*, 7*s*), whereby the element fixture (7*s*) disposed on the exit side is preferentially configured in a cavity form of cylindrical and/or conic tubular format.

In a first example (FIG. 2*a*), the actuation element (5) is thus provided for example in a single piece, initially retained in a removable manner in an element fixture (7*e*) disposed on the zone (2) facing the flow upstream, and in an element fixture (7*s*) disposed on the zone (3) facing the flow downstream. On a first moment (left drawing), there is no flow passage through the capsule (1) available. On a second moment (centre drawing), by means of applying a certain first actuation force (F), preferentially exerted at least in a mechanical manner, exerted as an example by the flow injection (11) provided in an extraction chamber (10) of a device according to the invention, the actuation element (5) is displaced so that it is released one flow passage ($S_1$) allowing the pressurized flow to enter inside the capsule. In the present case, said flow passage ($S_1$) is provided by a plurality of passageways (8) disposed on said flow injection (11). On a third moment (drawing on the right), by means of the application of a second actuation force (F), eventually of different dimension than the first one, preferentially exerted at least in hydraulic manner (i.e., by means of a fluid), the actuation element (5) is displaced again, so that it is released a second section of flow passage ($S_2$), in this case allowing the pressurized flow to exit the capsule (1).

In a second example (FIG. 2*b*), the actuation element is provided in two element parts (5*e*, 5*s*), each being initially retained in a removable manner in a respective element fixture (7*e*, 7*s*), whereby these element parts (5*e*, 5*s*) engage at least temporarily with each other via an elongated stem (5*d*). As illustrated in FIG. 2*b*, the element part (5*e*) is initially fitted in the element fixture (7*e*) to block flow. As shown in FIGS. 1*a*, 1*b*, the element part (5*e*) is cylindrically shaped. The other element part (5*s*) is initially fitted in the other element fixture (7*e*) to block flow, and the elongated stem (5*d*) is provided between the two element parts (5*e*, 5*s*). As shown in FIGS. 1*a*, 1*b*, the element part (5*s*) is also cylindrically shaped, for fitting in the cylindrical or tubular cavity of the element fixture (7*s*). On a first moment (drawing to the left), the actuation element (5*e*) on the entry is thus retained in a position in which the respective passageways (8) are blocked by the respective element fixture (7*e*). On a second moment (drawing in the centre), a first actuation force ($F_1$) is applied upon the actuation element (5*e*) so that the latter is displaced at least in such an extension that it unblocks the passageways (8) and/or a region of permeable material (9) and/or with filtering effect, provided in the opening actuation element (5*e*), and a corresponding flow passage ($S_1$) is thus released of entry inside the capsule (1). Moreover, on the course of its displacement, the actuation element (5*e*) simultaneously transmits at least part of said first actuation force ($F_1$) to the actuation element (5*s*) on the exit. As a result of this engagement, the actuation element (5*s*) is displaced from a first retention position to a following retention, in this case along such a distance that it unblocks a plurality of passageways (8) and/or zone of liquid permeable material (9) and/or with filtering effect provided in the element fixture (7*s*), thus releasing a flow passage ($S_3$) into the interior of an accumulation chamber (6) defined in its interior. On a third moment (drawing to the right), as a result of fluid accumulation in said accumulation chamber (6) it is developed an increasing pressure force inside thereof until a second actuation force ($F_2$) is exerted, at least by hydraulic way, upon said actuation element (5*s*) so that the latter moves to a following retention position, thus releasing one flow passage ($S_2$) from the accumulation chamber (6) and out of the capsule (1).

According to a preferred embodiment of the invention, the volume of the accumulation chamber (6) is previously dimensioned so that a certain hydraulic actuation force ($F_H$) is generated in such a location, corresponding to the actuation force (F) necessary to carry out the displacement of the actuation element (5*s*).

Figure 3:
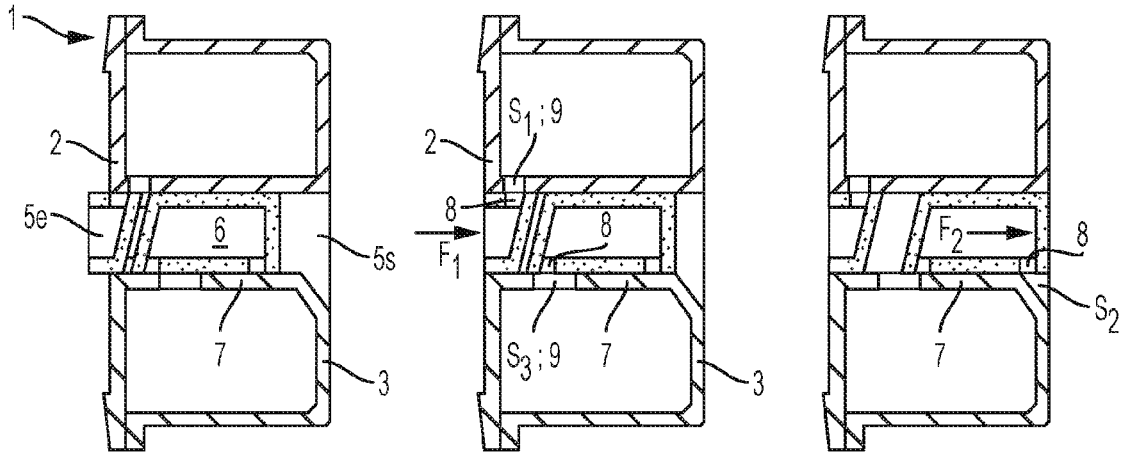
FIG. 3: schematic representation in cut, along the AA plane, of a second embodiment of a capsule (1) according to the invention, including three successive moments of evolution of an actuation element (5*e*, 5*s*) in an element fixture (7)

FIG. 3 corresponds to a preferred embodiment (again including three drawings, each of which corresponding to successive moments of the operation), in which the capsule (1) is provided with sections of flow passage distributed in asymmetrical manner, at least along a radial direction, so as to improved the resulting flow pattern, in particular when it is crossed by a pressurized flow developing along a substantially horizontal direction. Moreover, in the case of this embodiment, the element fixture (7) is provided in a single piece, of cylindrical and/or conic tubular format, preferentially produced in a single piece with at least one other construction element of the capsule (1).

On a first moment (drawing to the left), the actuation elements (5*e*, 5*s*) are retained in such a way in the element fixture (7) that there is no flow passage available through the capsule (1). On a second moment (drawing in the centre), by means of applying a certain first actuation force ($F_1$), the actuation elements (5*e*, 5*s*) are jointly displaced along such a distance that passageways (8) become in fluid communication with respective zones (9) of permeable material provided in each case in the element fixture (7). As a result there are provided flow passages ($S_1$, $S_3$) for entry in the capsule and in an accumulation chamber (6) defined in the interior of the actuation element (5*s*). In this respect, particular attention is called upon the fact that said passageways (8) present a variable dimension and are disposed at certain distances in-between and in asymmetrical manner radially, so that it results a more effective flow distribution through the aromatic substance. In this case, as an example, the openings of the entry in the capsule (1) are disposed in a perimeter zone of the actuation element (5*e*) that is oriented upwards, whereas the openings of entry in the accumulation chamber (6) are disposed in a perimeter zone of the actuation element (5*s*) that is oriented downwards. On a third moment, as a result of a second actuation force ($F_2$), the actuation element (5*s*) is moved along such an extension that a flow passage ($S_2$) is released of exit from the capsule (1), in this case provided by a plurality of passageways (8) disposed on a perimeter zone thereof that is oriented downwards, and in the interior of a cavity correspondingly provided in part of the perimeter of the element fixture (7).

Figure 4:
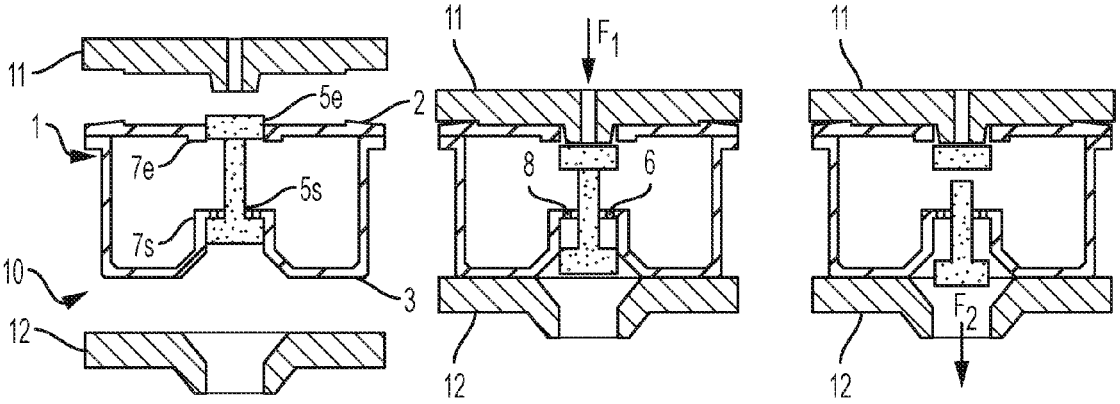
FIG. 4: schematic diagram of the evolution of three moments of an embodiment of the method of processing according to the invention.

FIG. 4 are three schematic views of in each case successive moments of a preferred embodiment of the method and device according to the invention. One capsule (1) according to the invention is thus initially introduced in an extraction chamber (10) of a device according to the invention along an indiscriminate orientation, preferentially along a previously defined orientation. According to a preferred embodiment, the introduction takes place so that the actuation element (5*e*, 5*s*) on the side upstream and on the side downstream result in each case substantially aligned with a flow infusion element (11) and an infusion discharge element (12), respectively (drawing to the left). In a following step, it is carried out the mechanical clamping of the capsule (1) in a respective extraction position. According to a preferred embodiment, is simultaneously exerted by a first actuation force ($F_1$) of the actuation element (5) of capsule (drawing in the centre). Afterwards, or substantially simultaneously with the mechanical clamping it is initiated the injection of the pressurized fluid flow, such as for example hot water, through the flow injection (11) of actuation of the actuation element (5) of capsule (1). The opening of a flow passage ($S_1$) of entry in the capsule may take place immediately after the mechanical clamping, or only after the beginning of the flow injection. On a following moment (drawing on the right), as a result of the entry of flow in the capsule, a second actuation force ($F_2$) is exerted or generated so that a flow passage ($S_2$) is released that allows the flow to exit out of the capsule (1).

The invention claimed is:

1. A capsule comprising:

at least one construction element defining a zone of the capsule facing the flow upstream and a zone of the capsule facing the flow downstream in opposition to each other, an actuation element extending along at least part of the distance between said zones facing the flow upstream and downstream, the actuation element including two element parts that engage at least temporarily with each other, the actuation element retained in a movable manner in said construction element by means of the two element parts each in a respective element fixture respectively provided in said zones facing the flow upstream and downstream, wherein at least one of the two element parts includes and/or defines together with their respective element fixtures, a flow accumulation chamber provided on the side of the zone facing the flow downstream, and wherein the actuation element includes and/or defines together with said element fixtures, at least one flow exit passage for discharge of the flow out of said accumulation chamber and of the capsule, wherein one of the at least one of the two element parts blocks the at least one flow exit passage in said respective element fixture, and as a result of a predetermined flow accumulation inside the flow accumulation chamber, the actuation element is caused to move to a position wherein the element part unblocks the at least one flow exit passage.

2. The capsule according to claim 1, wherein the actuation element carries out at least two successive displacements, in each case as a result of applying a certain actuation force, in each case resulting in at least one flow passage for entry of the flow inside the capsule, and at least one flow passage for discharge of the flow out of the capsule, respectively.

3. The capsule according to claim 1, wherein, as a result of the displacement of the actuation element, at least one flow passage is released for entry of the flow inside the accumulation chamber.

4. The capsule according to claim 1, wherein the actuation element and/or the element fixtures are provided with a plurality of passageways and/or with at least one permeable material, and the at least one flow exit passage through the accumulation chamber is provided when said passageways in the actuation element and/or in the element fixtures, are in each case unobstructed or are in substantial fluid communication with each other.

5. The capsule according to claim 1, wherein the element parts of the actuation element are configured so as move in isolation one relative to the other, along at least part of the distance between the zone of flow upstream and the zone of flow downstream.

6. The capsule according to claim 1, wherein a total displacement of the actuation element and/or a volume of the accumulation chamber are previously defined as a function of at least one type of aromatic substance, or of a dimension of a grain of said substance or of an interior volume of the capsule.

7. The capsule according to claim 1, wherein the configuration of at least one of the flow passages of entry inside the accumulation chamber and exit out of the capsule, including the form, the dimension and the distribution of respective passageways, is previously defined as a function at least of a type of aromatic substance, or of a dimension of a grain of said aromatic substance, or of an interior volume of the capsule.

8. The capsule according to claim 1, wherein a plurality of flow passages are disposed successively along the prevailing flow direction, whereby respective passageways are provided radially in a substantially uniform manner relative to a central symmetry axis of the capsule.

9. The capsule according to claim 1, wherein the two element parts of the actuation element are provided so that at least one may move at least partially along the other, or at least one may move along at least part of a respective element fixture, at least along the prevailing flow direction.

10. The capsule according to claim 1, wherein the extension of the element part on the side of the zone facing the flow upstream, is previously defined as a function at least of a type of aromatic substance, or an average dimension of a grain of the aromatic substance, or an interior volume of the capsule.

11. A device for using a capsule, the capsule comprising at least one construction element that defines a zone facing the flow upstream and a zone facing the flow downstream disposed in opposition to each other, and presenting an actuation element extending along at least part of the distance between said zones facing the flow upstream and downstream, and retained in a movable manner by means of two element parts that engage at least temporarily with each other, each in a respective element fixture provided in said zones facing the flow upstream and downstream, wherein the actuation element includes and/or defines together with said element fixtures, a flow accumulation chamber provided on the side of the zone facing the flow downstream, and the actuation element includes and/or defines together with said element fixtures, at least one flow exit passage for discharge of the flow out of said accumulation chamber and of the capsule, wherein one of the at least two element parts blocks the at least one flow exit passage in said respective element fixture, and as a result of a predetermined flow accumulation inside the flow accumulation chamber, the actuation element is caused to move to a position wherein the element part unblocks the at least one flow exit passage, and wherein the device comprises at least one extraction chamber and is configured to:

introduce the capsule in the extraction chamber, fix said capsule by mechanical clamping in said extraction chamber to exert a first actuation force (F1) upon the actuation element at least on the side of the zone facing the flow upstream so as to displace the actuation element, inject a fluid flow under a previously defined pressure and during a period of time, to exert a second actuation force (F2) upon the actuation element at least on the side of the zone facing the flow upstream so as to displace the actuation element so as to provide a flow passage out of the capsule.

* * * * *